US012129861B2

(12) United States Patent
Takahashi

(10) Patent No.: US 12,129,861 B2
(45) Date of Patent: Oct. 29, 2024

(54) VACUUM PUMP AND ROTATING BODY FOR VACUUM PUMP

(71) Applicant: Edwards Japan Limited, Yachiyo (JP)

(72) Inventor: Katsunori Takahashi, Yachiyo (JP)

(73) Assignee: Edwards Japan Limited, Yachiyo (JP)

( * ) Notice: Subject to any disclaimer, the term of this patent is extended or adjusted under 35 U.S.C. 154(b) by 59 days.

(21) Appl. No.: 18/000,047

(22) PCT Filed: May 28, 2021

(86) PCT No.: PCT/JP2021/020480
§ 371 (c)(1),
(2) Date: Nov. 28, 2022

(87) PCT Pub. No.: WO2021/246337
PCT Pub. Date: Dec. 9, 2021

(65) Prior Publication Data

US 2023/0243359 A1 Aug. 3, 2023

(30) Foreign Application Priority Data

Jun. 5, 2020 (JP) ..... 2020-098534

(51) Int. Cl.
*F04D 19/04* (2006.01)

(52) U.S. Cl.
CPC ..... *F04D 19/042* (2013.01); *F04D 19/048* (2013.01)

(58) Field of Classification Search
CPC ..... F04D 19/048; F04D 29/00; F16C 2360/45
See application file for complete search history.

(56) References Cited

U.S. PATENT DOCUMENTS 5,020,969 A * 6/1991 Mase ..... F04D 23/008 415/55.1
6,135,709 A 10/2000 Stones
2005/0220606 A1 10/2005 Beyer et al.

FOREIGN PATENT DOCUMENTS

JP H11351190 A 12/1999
JP 2001304174 A 10/2001
JP 2002206497 A 7/2002
JP 2005519236 A 6/2005
(Continued)

OTHER PUBLICATIONS

International Search Report and Written Opinion of International Application No. PCT/JP2021/020480 dated Aug. 10, 2021, 9 Pages.

*Primary Examiner* — Kenneth J Hansen
(74) *Attorney, Agent, or Firm* — Shumaker & Sieffert, P.A.

(57) ABSTRACT

An object is to prevent backflow of particles during discharging. The vacuum pump includes: a casing having an inlet port and an outlet port; a stator column provided upright inside the casing; a rotating body having a shape surrounding an outer circumference of the stator column; and a magnetic bearing configured to magnetically levitate and support a rotating shaft of the rotating body, with the vacuum pump being configured to suck gas from the inlet port and exhaust the gas from the outlet port by rotation of the rotating body, wherein a projection portion for discharging an electric charge carried on the rotating body is provided at at least one of a first position formed on a back surface side of the rotating body, a second position formed on a bottom surface side of the rotating body, and a third position formed in an intermediate point of a flow passage of the gas of the rotating body.

9 Claims, 7 Drawing Sheets

(A) MAGNETICALLY LEVITATED (B) NOT MAGNETICALLY LEVITATED

(56) References Cited

FOREIGN PATENT DOCUMENTS

| | | | | |
|---|---|---|---|---|
| JP | 2009504987 | A | 2/2009 | |
| WO | 2003076809 | A1 | 9/2003 | |
| WO | WO-2007022332 | A2 * | 2/2007 | ..... F04D 19/04 |

* cited by examiner (A) MAGNETICALLY LEVITATED (B) NOT MAGNETICALLY LEVITATED (A) MAGNETICALLY LEVITATED (B) NOT MAGNETICALLY LEVITATED

VACUUM PUMP AND ROTATING BODY FOR VACUUM PUMP

This application is a U.S. national phase application under 35 U.S.C. § 371 of international application number PCT/JP2021/020480 filed on May 28, 2021, which claims the benefit of JP application number 2020-098534 filed on Jun. 5, 2020. The entire contents of each of international application number PCT/JP2021/020480 and JP application number 2020-098534 are incorporated herein by reference.

TECHNICAL FIELD

The present disclosure relates to a vacuum pump and a rotating body for a vacuum pump.

BACKGROUND

A technique is known that discharges an electric charge carried on a rotor of a vacuum pump through a discharging means. For example, Japanese Patent Application Publication No. 2002-206497 describes a turbomolecular pump having a configuration in which "a rotor including rotor blades, a stator including stator blades paired with the rotor blades to form a turbine, a rotating shaft provided on the rotor, with an axis thereof being a rotation axis of the rotor, an electromagnetic motor for applying a rotational force to the rotating shaft, and a magnetic bearing for supporting the rotating shaft by magnetically levitating the rotating shaft are provided, and a discharging needle provided on the rotor or the stator along the rotation axis of the rotor discharges to the stator an electric charge charged on the rotor." (see the abstract).

SUMMARY

However, in Japanese Patent Application Publication No. 2002-206497, since the discharging needle is arranged near a suction port of the vacuum pump, particles adhering to the discharging needle scatter into exhaust gas during discharging. These particles flow back toward a vacuum chamber placed upstream of the vacuum pump. This may cause contamination in the vacuum chamber.

In view of the foregoing, it is an object of the present disclosure to provide a vacuum pump and a rotating body for the vacuum pump that can prevent backflow of particles during discharging.

To achieve the above object, one aspect of the present disclosure is a vacuum pump including: a casing having an inlet port and an outlet port; a stator column provided upright inside the casing; a rotating body having a shape surrounding an outer circumference of the stator column; and a magnetic bearing configured to magnetically levitate and support a rotating shaft of the rotating body, with the vacuum pump being configured to suck gas from the inlet port and exhaust the gas from the outlet port by rotation of the rotating body, wherein a projection portion for discharging an electric charge carried on the rotating body is provided at least one of a first position formed on a back surface side of the rotating body, a second position formed on a bottom surface side of the rotating body, and a third position formed in an intermediate point of a flow passage of the gas of the rotating body.

In the above configuration, the projection portion is preferably provided at the first position formed on a surface in the back surface of the rotating body, with the surface facing an upper end surface of the stator column, and is configured to discharge the electric charge, carried on the rotating body toward the stator column.

In the above configuration, the projection portion is preferably set to have a height that does not cause the projection portion to come into physical contact with an upper end surface of the stator column even in a state in which the rotating body is not magnetically levitated.

In the above configuration, a purge gas flow passage, in which purge gas flows, is preferably formed between the back surface of the rotating body and the upper end surface of the stator column.

In the above configuration, the projection portion is preferably provided at the second position formed on a bottom surface of a cylindrical portion forming a lower portion of the rotating body and is configured to discharge the electric charge, carried on the rotating body, toward a base portion forming a bottom portion of the casing.

In the above configuration, the projection portion is preferably set to have a height that does not cause the projection portion to come into physical contact with the base portion even in a state in which the rotating body is not magnetically levitated.

In the above configuration, a purge gas flow passage, in which purge gas flows, is preferably formed between the bottom surface of the cylindrical portion and the base portion.

In the above configuration, the rotating body preferably includes, in multiple stages, a plurality of rotor blades, the casing preferably includes, in multiple stages, a plurality of stator blades provided in a staggered manner with the plurality of rotor blades, and the projection portion is preferably provided at the third position formed on a surface of the rotor blade that is located on a lower stage side, and is configured to discharge the electric charge carried on the rotating body toward the stator blade that is located in one of the stages located above and under the rotor blade that is located on the lower stage side.

In the above configuration, the projection portion preferably has a pointed shape.

In the above configuration, the projection portion preferably has a gas release hole.

In the above configuration, the projection portion is preferably provided in plurality, and the plurality of projection portions are preferably located at a same radius about an axis of the rotating body and located at mutually regular intervals in a rotational direction with respect to the axis of the rotating body.

To achieve the object, another aspect of the present disclosure is a rotating body for a vacuum pump, the rotating body being configured to be incorporated into a vacuum pump that sucks gas from an inlet port and exhausts the gas from an outlet port and magnetically levitated and rotatably supported by a magnetic bearing, wherein a projection portion for discharging an electric charge carried on the rotating body is provided at at least one of a first position formed on a back surface side of the rotating body, a second position formed on a bottom surface side of the rotating body, and a third position formed in an intermediate point of a flow passage of the gas of the rotating body.

According to the present disclosure, backflow of particles can be prevented during discharging. As a result, contamination in the vacuum chamber can be prevented. Problems to be solved, configurations, and advantageous effects other than those described above will be recognized by the following description of examples.

BRIEF DESCRIPTION OF THE DRAWINGS

FIGS. 5A and 5B are diagrams showing details of a projection portion 10, in which FIG. 5A is a diagram showing a state in which a rotating body is magnetically levitated, and FIG. 5B is a diagram showing a state in which the rotating body is not magnetically levitated.

FIGS. 6A and 6B are diagrams showing details of a projection portion 20, in which FIG. 6A is a diagram showing a state in which the rotating body is magnetically levitated, and FIG. 6B is a diagram showing a state in which the rotating body is not magnetically levitated.

DETAILED DESCRIPTION

Figure 1:
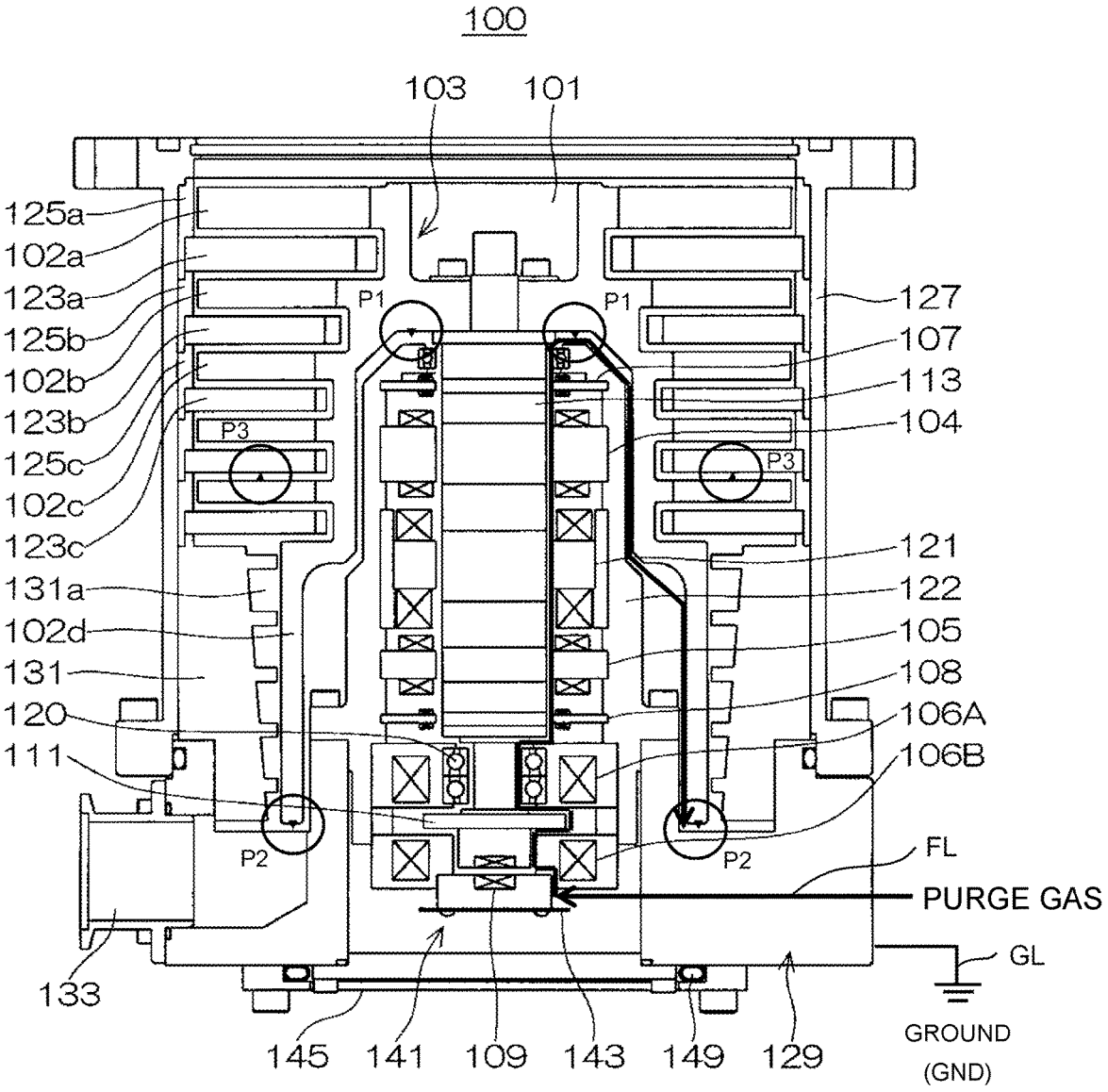
FIG. 1 is a vertical cross-sectional view of a turbomolecular pump according to an example of the present disclosure.

Referring to the drawings, an example of a vacuum pump according to the present disclosure is now described using a turbomolecular pump as an example.

FIG. 1 is a vertical cross-sectional view of a turbomolecular pump 100A. As shown in FIG. 1, the turbomolecular pump 100 includes a circular outer cylinder 127 and has an inlet port 101 at its upper end. A rotating body 103 in the outer cylinder 127 includes a plurality of rotor blades 102*a*, 102*b*, 102*c*, . . . , which are turbine blades for gas suction and exhaustion, in its outer circumference section. The rotor blades 102 extend radially in multiple stages. The rotating body 103 has a rotor shaft 113 in its center. The rotor shaft 113 is suspended in the air and position-controlled by a magnetic bearing of 5-axis control, for example.

Upper radial electromagnets 104 include four electromagnets arranged in pairs on an X-axis and a Y-axis. Four upper radial sensors 107 are provided in close proximity to the upper radial electromagnets 104 and associated with the respective upper radial electromagnets 104. Each upper radial sensor 107 may be an inductance sensor or an eddy current sensor having a conduction winding, for example, and detects the position of the rotor shaft 113 based on a change in the inductance of the conduction winding, which changes according to the position of the rotor shaft 113. The upper radial sensors 107 are configured to detect a radial displacement of the rotor shaft 113, that is, the rotating body 103 fixed to the rotor shaft 113, and send it to a controller (not shown).

In the controller, for example, a compensation circuit having a PID adjustment function generates an excitation control command signal for the upper radial electromagnets 104 based on a position signal detected by the upper radial sensors 107. Based on this excitation control command signal, an amplifier circuit 150 (described below) controls and excites the upper radial electromagnets 104 to adjust a radial position of an upper part of the rotor shaft 113.

The rotor shaft 113 may be made of a high magnetic permeability material (such as iron and stainless steel) and is configured to be attracted by magnetic forces of the upper radial electromagnets 104. The adjustment is performed independently in the X-axis direction and the Y-axis direction. Lower radial electromagnets 105 and lower radial sensors 108 are arranged in a similar manner as the upper radial electromagnets 104 and the upper radial sensors 107 to adjust the radial position of the lower part of the rotor shaft 113 in a similar manner as the radial position of the upper part.

Additionally, axial electromagnets 106A and 106B are arranged so as to vertically sandwich a metal disc 111, which has a shape of a circular disc and is provided in the lower part of the rotor shaft 113. The metal disc 111 is made of a high magnetic permeability material such as iron. An axial sensor 109 is provided to detect an axial displacement of the rotor shaft 113 and send an axial position signal to the controller.

In the controller, the compensation circuit having the PID adjustment function may generate an excitation control command signal for each of the axial electromagnets 106A and 106B based on the signal on the axial position detected by the axial sensor 109. Based on these excitation control command signals, the amplifier circuit 150 controls and excites the axial electromagnets 106A and 106B separately so that the axial electromagnet 106A magnetically attracts the metal disc 111 upward and the axial electromagnet 106B attracts the metal disc 111 downward. The axial position of the rotor shaft 113 is thus adjusted.

As described above, the controller appropriately adjusts the magnetic forces exerted by the axial electromagnets 106A and 106B on the metal disc 111, magnetically levitates the rotor shaft 113 in the axial direction, and suspends the rotor shaft 113 in the air in a non-contact manner. The amplifier circuit 150, which controls and excites the upper radial electromagnets 104, the lower radial electromagnets 105, and the axial electromagnets 106A and 106B, is described below.

The motor 121 includes a plurality of magnetic poles circumferentially arranged to surround the rotor shaft 113. Each magnetic pole is controlled by the controller so as to drive and rotate the rotor shaft 113 via an electromagnetic force acting between the magnetic pole and the rotor shaft 113. The motor 121 also includes a rotational speed sensor (not shown), such as a Hall element, a resolver, or an encoder, and the rotational speed of the rotor shaft 113 is detected based on a detection signal of the rotational speed sensor.

Furthermore, a phase sensor (not shown) is attached adjacent to the lower radial sensors 108 to detect the phase of rotation of the rotor shaft 113. The controller detects the position of the magnetic poles using both detection signals of the phase sensor and the rotational speed sensor.

A plurality of stator blades 123 (123*a*, 123*b*, 123*c*, . . . ) are arranged slightly spaced apart from the rotor blades 102 (102*a*, 102*b*, 102*c*, . . . ). Each of rotor blades 102*a*, 102*b*, 102*c*, . . . is inclined by a predetermined angle from a plane perpendicular to the axis of the rotor shaft 113 in order to transfer exhaust gas molecules downward through collision.

The stator blades 123 are also inclined by a predetermined angle from a plane perpendicular to the axis of the rotor shaft 113. The stator blades 123 extend inward of the outer cylinder 127 and alternate with the stages of the rotor blades 102. The outer circumference ends of the stator blades 123 are inserted between and thus supported by a plurality of layered stator blade spacers 125 (125*a*, 125*b*, 125*c*, . . . ).

The stator blade spacers 125 are ring-shaped members made of a metal, such as aluminum, iron, stainless steel, or copper, or an alloy containing these metals as components, for example. The outer cylinder 127 is fixed to the outer circumferences of the stator blade spacers 125 with a slight gap. A base portion 129 is located at the base of the outer cylinder 127. The base portion 129 has an outlet port 133 providing communication to the outside. The exhaust gas transferred to the base portion 129 is sent to the outlet port 133. The base portion 129 is grounded. However, the grounding portion is not limited to the base portion 129 and may be the outer cylinder 127.

According to the application of the turbomolecular pump 100, a threaded spacer 131 may be provided between the lower part of the stator blade spacer 125 and the base portion 129. The threaded spacer 131 is a cylindrical member made of a metal such as aluminum, copper, stainless steel, or iron, or an alloy containing these metals as components. The threaded spacer 131 has a plurality of helical thread grooves 131*a* in its inner circumference surface. When exhaust gas molecules move in the rotation direction of the rotating body 103, these molecules are transferred toward the outlet port 133 in the direction of the helix of the thread grooves 131*a*. In the lowermost section of the rotating body 103 below the rotor blades 102*a*, 102*b*, 102*c*, . . . , a cylindrical portion 102*d* extends downward. The outer circumference surface of the cylindrical portion 102*d* is cylindrical and projects toward the inner circumference surface of the threaded spacer 131. The outer circumference surface is adjacent to but separated from the inner circumference surface of the threaded spacer 131 by a predetermined gap. The exhaust gas transferred to the thread grooves 131*a* by the rotor blades 102 and the stator blades 123 is guided by the thread grooves 131*a* to the base portion 129.

The base portion 129 is a disc-shaped member forming the base section of the turbomolecular pump 100, and is generally made of a metal such as iron, aluminum, or stainless steel. The base portion 129 physically holds the turbomolecular pump 100 and also serves as a heat conduction path. As such, the base portion 129 is preferably made of rigid metal with high thermal conductivity, such as iron, aluminum, or copper.

In this configuration, when the motor 121 drives and rotates the rotor blades 102 together with the rotor shaft 113, the interaction between the rotor blades 102 and the stator blades 123 causes the suction of exhaust gas from the vacuum chamber through the inlet port 101. The exhaust gas taken through the inlet port 101 moves between the rotor blades 102 and the stator blades 123 and is transferred to the base portion 129. At this time, factors such as the friction heat generated when the exhaust gas comes into contact with the rotor blades 102 and the conduction of heat generated by the motor 121 increase the temperature of the rotor blades 102. This heat is conducted to the stator blades 123 through radiation or conduction via gas molecules of the exhaust gas, for example.

The stator blade spacers 125 are joined to each other at the outer circumference portion and conduct the heat received by the stator blades 123 from the rotor blades 102, the friction heat generated when the exhaust gas comes into contact with the stator blades 123, and the like to the outside.

In the above description, the threaded spacer 131 is provided at the outer circumference of the cylindrical portion 102*d* of the rotating body 103, and the thread grooves 131*a* are engraved in the inner circumference surface of the threaded spacer 131. However, this may be inversed in some cases, and a thread groove may be engraved in the outer circumference surface of the cylindrical portion 102*d*, while a spacer having a cylindrical inner circumference surface may be arranged around the outer circumference surface.

According to the application of the turbomolecular pump 100, to prevent the gas drawn through the inlet port 101 from entering an electrical portion, which includes the upper radial electromagnets 104, the upper radial sensors 107, the motor 121, the lower radial electromagnets 105, the lower radial sensors 108, the axial electromagnets 106A, 106B, and the axial sensor 109, the electrical portion may be surrounded by a stator column 122. The inside of the stator column 122 may be maintained at a predetermined pressure by purge gas.

In this case, the base portion 129 has a pipe (not shown) through which the purge gas is introduced. The introduced purge gas is sent to the outlet port 133 through gaps between a protective bearing 120 and the rotor shaft 113, between the rotor and the stator of the motor 121, and between the stator column 122 and the inner circumference cylindrical portion of the rotor blade 102 (see a purge gas flow passage FL in FIG. 1).

The turbomolecular pump 100 uses the identification of the model and control based on individually adjusted unique parameters (for example, various characteristics associated with the model). To store these control parameters, the turbomolecular pump 100 includes an electronic circuit portion 141 in its main body. The electronic circuit portion 141 may include a semiconductor memory, such as an EEPROM, electronic components such as semiconductor elements for accessing the semiconductor memory, and a substrate 143 for mounting these components. The electronic circuit portion 141 is housed under a rotational speed sensor (not shown) near the center, for example, of the base portion 129, which forms the lower part of the turbomolecular pump 100, and is closed by an airtight bottom lid 145.

Some process gas introduced into the vacuum chamber in the manufacturing process of semiconductors has the property of becoming solid when its pressure becomes higher than a predetermined value or its temperature becomes lower than a predetermined value. In the turbomolecular pump 100A, the pressure of the exhaust gas is lowest at the inlet port 101 and highest at the outlet port 133. When the pressure of the process gas increases beyond a predetermined value or its temperature decreases below a predetermined value while the process gas is being transferred from the inlet port 101 to the outlet port 133, the process gas is solidified and adheres and accumulates on the inner side of the turbomolecular pump 100.

For example, when SiCl4 is used as the process gas in an Al etching apparatus, according to the vapor pressure curve, a solid product (for example, AlCl3) is deposited at a low vacuum (760 [torr] to 10-2 [torr]) and a low temperature (about 20 [° C.]) and adheres and accumulates on the inner side of the turbomolecular pump 100. When the deposit of the process gas accumulates in the turbomolecular pump 100, the accumulation may narrow the pump flow passage and degrade the performance of the turbomolecular pump 100. The above-mentioned product tends to solidify and adhere in areas with higher pressures, such as the vicinity of the outlet port and the vicinity of the threaded spacer 131.

To solve this problem, conventionally, a heater or annular water-cooled tube 149 (not shown) is wound around the outer circumference of the base portion 129, and a temperature sensor (e.g., a thermistor, not shown) is embedded in the base portion 129, for example. The signal of this temperature sensor is used to perform control to maintain the temperature of the base portion 129 at a constant high temperature (preset temperature) by heating with the heater or cooling with the water-cooled tube 149 (hereinafter referred to as TMS (temperature management system)).

Figure 2:
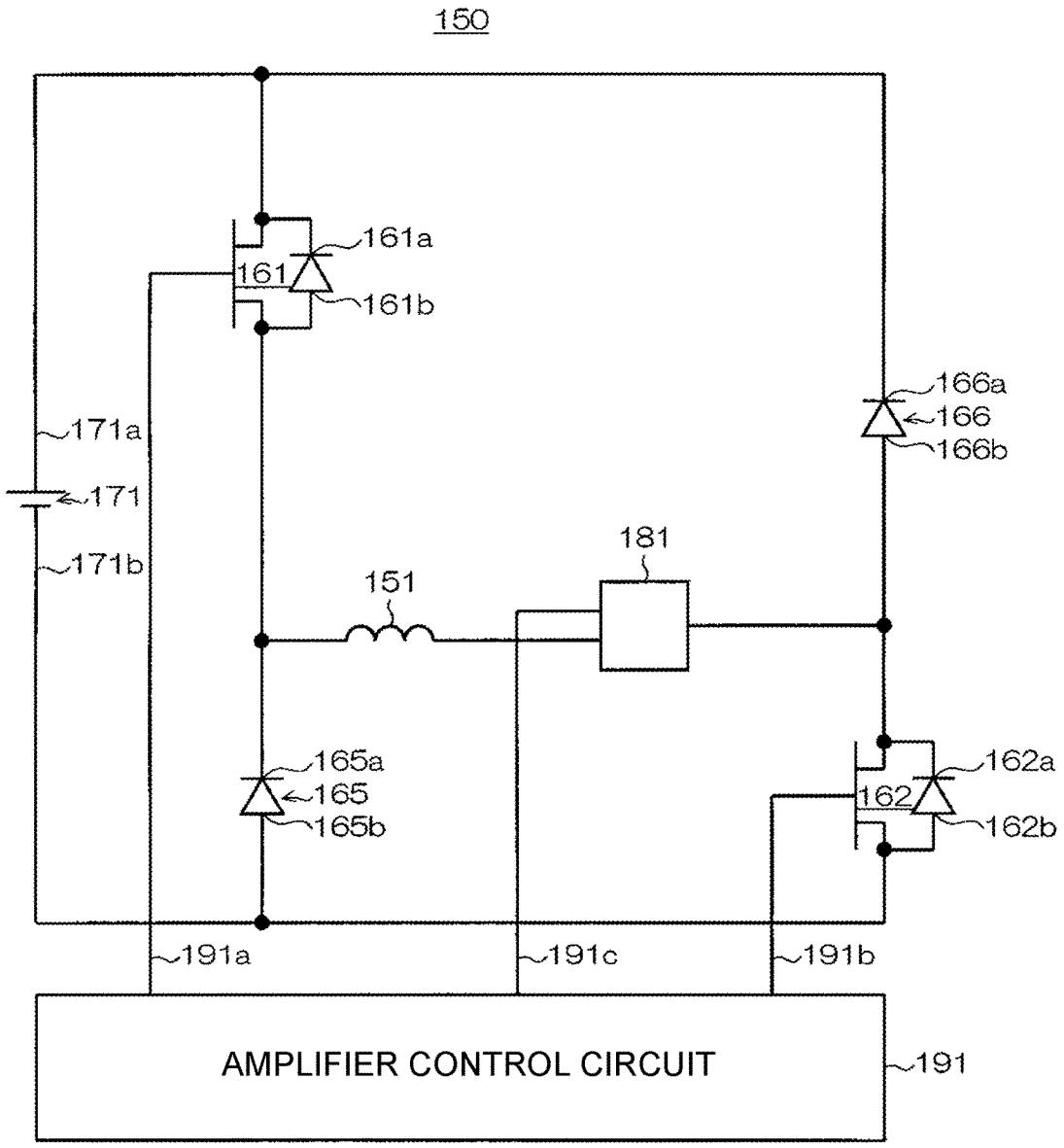
FIG. 2 is a circuit diagram of an amplifier circuit of the turbomolecular pump shown in FIG. 1.

The amplifier circuit 150 is now described that controls and excites the upper radial electromagnets 104, the lower radial electromagnets 105, and the axial electromagnets 106A and 106B of the turbomolecular pump 100 configured as described above. FIG. 2 is a circuit diagram of the amplifier circuit.

In FIG. 2, one end of an electromagnet winding 151 forming an upper radial electromagnet 104 or the like is connected to a positive electrode 171*a* of a power supply 171 via a transistor 161, and the other end is connected to a negative electrode 171*b* of the power supply 171 via a current detection circuit 181 and a transistor 162. Each transistor 161, 162 is a power MOSFET and has a structure in which a diode is connected between the source and the drain thereof.

In the transistor 161, a cathode terminal 161*a* of its diode is connected to the positive electrode 171*a*, and an anode terminal 161*b* is connected to one end of the electromagnet winding 151. In the transistor 162, a cathode terminal 162*a* of its diode is connected to a current detection circuit 181, and an anode terminal 162*b* is connected to the negative electrode 171*b*.

A diode 165 for current regeneration has a cathode terminal 165*a* connected to one end of the electromagnet winding 151 and an anode terminal 165*b* connected to the negative electrode 171*b*. Similarly, a diode 166 for current regeneration has a cathode terminal 166*a* connected to the positive electrode 171*a* and an anode terminal 166*b* connected to the other end of the electromagnet winding 151 via the current detection circuit 181. The current detection circuit 181 may include a Hall current sensor or an electric resistance element, for example.

The amplifier circuit 150 configured as described above corresponds to one electromagnet. Accordingly, when the magnetic bearing uses 5-axis control and has ten electromagnets 104, 105, 106A, and 106B in total, an identical amplifier circuit 150 is configured for each of the electromagnets. These ten amplifier circuits 150 are connected to the power supply 171 in parallel.

An amplifier control circuit 191 may be formed by a digital signal processor portion (not shown, hereinafter referred to as a DSP portion) of the controller. The amplifier control circuit 191 switches the transistors 161 and 162 between on and off.

The amplifier control circuit 191 is configured to compare a current value detected by the current detection circuit 181 (a signal reflecting this current value is referred to as a current detection signal 191*c*) with a predetermined current command value. The result of this comparison is used to determine the magnitude of the pulse width (pulse width time Tp1, Tp2) generated in a control cycle Ts, which is one cycle in PWM control. As a result, gate drive signals 191*a* and 191*b* having this pulse width are output from the amplifier control circuit 191 to gate terminals of the transistors 161 and 162.

Under certain circumstances such as when the rotational speed of the rotating body 103 reaches a resonance point during acceleration, or when a disturbance occurs during a constant speed operation, the rotating body 103 may use positional control at high speed and with a strong force. For this purpose, a high voltage of about 50 V, for example, is used for the power supply 171 to enable a rapid increase (or decrease) in the current flowing through the electromagnet winding 151. Additionally, a capacitor is generally connected between the positive electrode 171*a* and the negative electrode 171*b* of the power supply 171 to stabilize the power supply 171 (not shown).

In this configuration, when both transistors 161 and 162 are turned on, the current flowing through the electromagnet winding 151 (hereinafter referred to as an electromagnet current iL) increases, and when both are turned off, the electromagnet current iL decreases.

Also, when one of the transistors 161 and 162 is turned on and the other is turned off, a freewheeling current is maintained. Passing the freewheeling current through the amplifier circuit 150 in this manner reduces the hysteresis loss in the amplifier circuit 150, thereby limiting the power consumption of the entire circuit to a low level. Moreover, by controlling the transistors 161 and 162 as described above, high frequency noise, such as harmonics, generated in the turbomolecular pump 100 can be reduced. Furthermore, by measuring this freewheeling current with the current detection circuit 181, the electromagnet current iL flowing through the electromagnet winding 151 can be detected.

Figure 3:
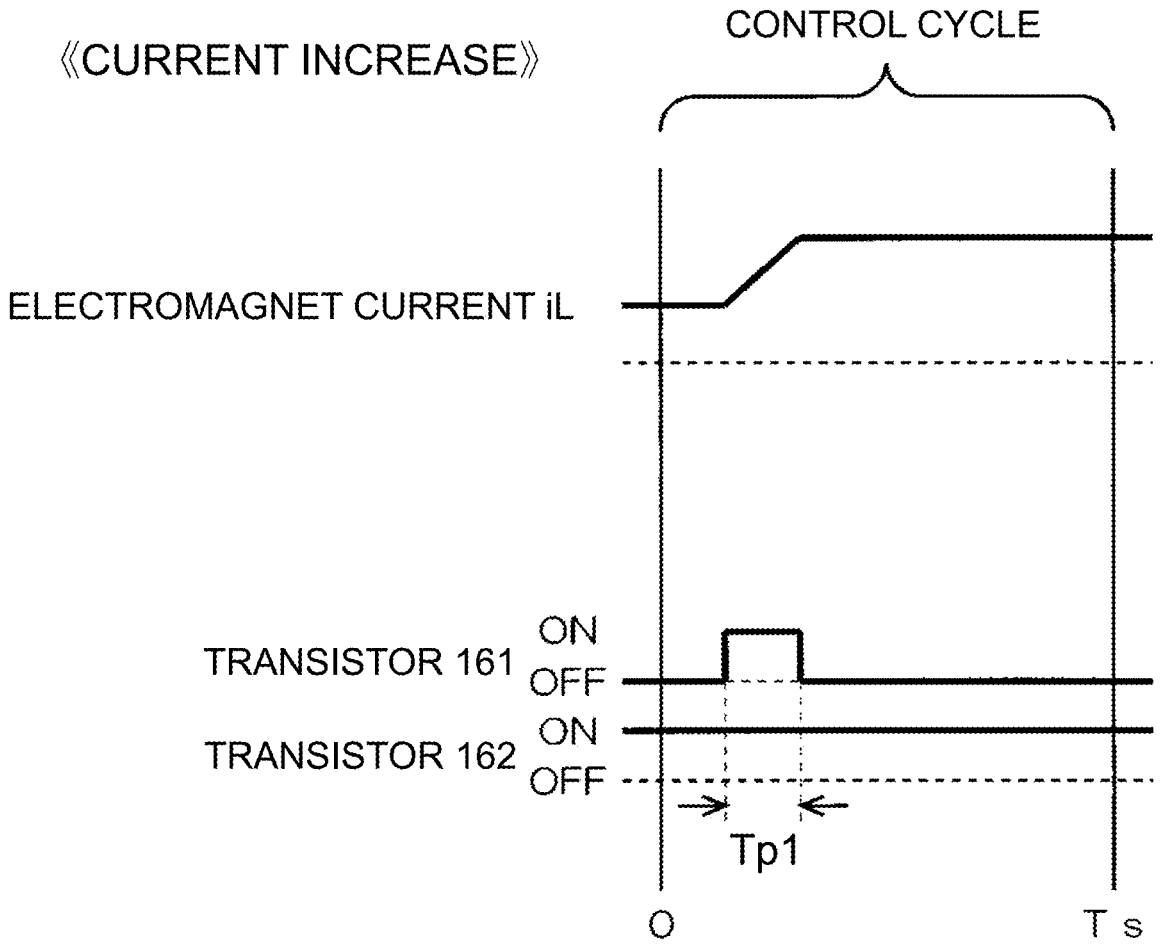
FIG. 3 is a time chart showing control of an amplifier control circuit performed when a current command value is greater than a detected value.

That is, when the detected current value is smaller than the current command value, as shown in FIG. 3, the transistors 161 and 162 are simultaneously on only once in the control cycle Ts (for example, 100 μs) for the time corresponding to the pulse width time Tp1. During this time, the electromagnet current iL increases accordingly toward the current value iLmax (not shown) that can be passed from the positive electrode 171*a* to the negative electrode 171*b* via the transistors 161 and 162.

Figure 4:
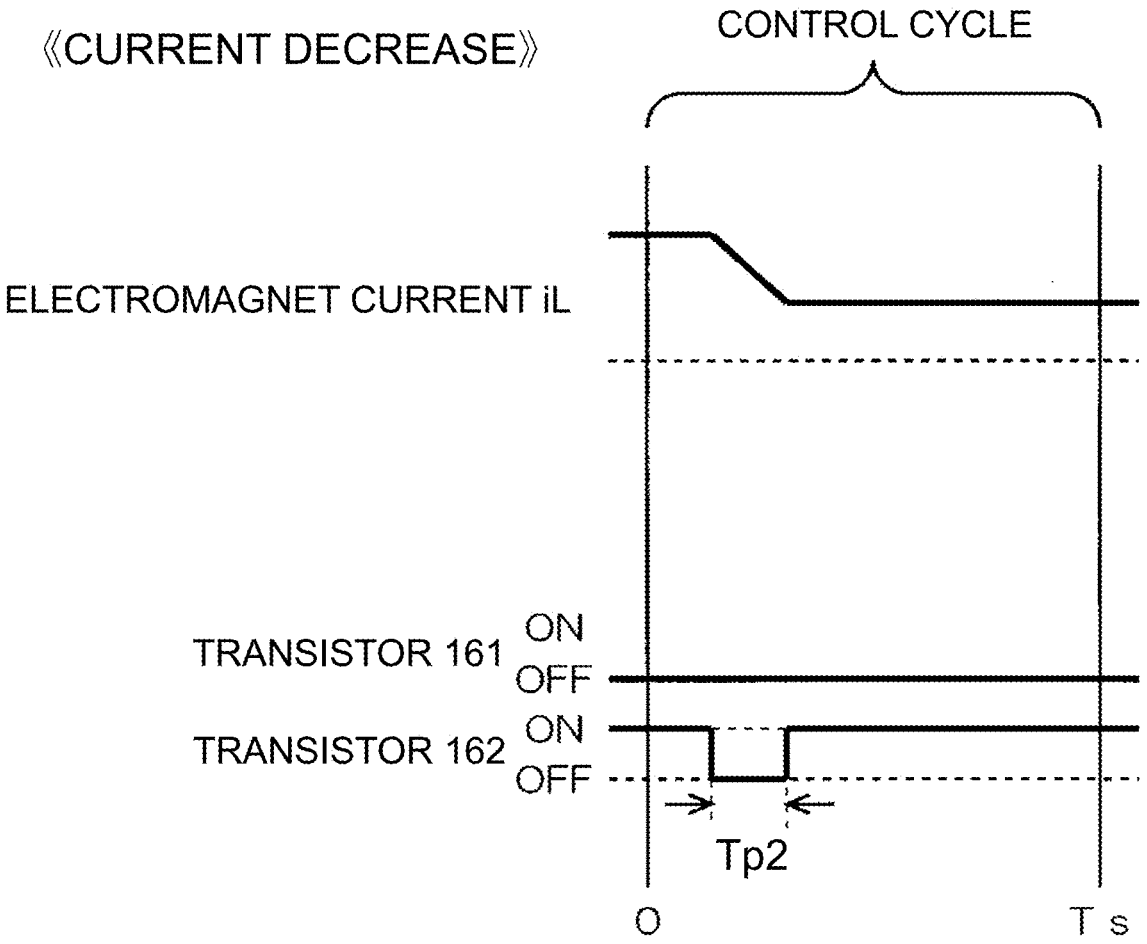
FIG. 4 is a time chart showing control of an amplifier control circuit performed when a current command value is less than a detected value.

When the detected current value is larger than the current command value, as shown in FIG. 4, the transistors 161 and 162 are simultaneously off only once in the control cycle Ts for the time corresponding to the pulse width time Tp2. During this time, the electromagnet current iL decreases accordingly toward the current value iLmin (not shown) that can be regenerated from the negative electrode 171*b* to the positive electrode 171*a* via the diodes 165 and 166.

In either case, after the pulse width time Tp1, Tp2 has elapsed, one of the transistors 161 and 162 is on. During this period, the freewheeling current is thus maintained in the amplifier circuit 150.

An antistatic structure of the above-described turbomolecular pump 100 is now described. For example, in a semiconductor manufacturing process, when plasma is generated in the vacuum chamber, this plasma enters the turbomolecular pump 100. Since the rotating body 103 of the turbomolecular pump 100 is levitated by the magnetic bearing, electric discharge is less likely to occur. As such, plasma tends to cause the rotating body 103 to carry an electric charge. The electric charge carried on the rotating body 103 needs to be discharged. However, when an electric charge is discharged from a surface of the rotating body 103 facing an exhaust gas flow passage, any particles adhering to the surface of the rotating body 103 may scatter into the gas during discharging, causing backflow of particles and contamination in the vacuum chamber. For this reason, to prevent contamination in the vacuum chamber, the present example has projection portions 10, 20, and 30 as discharging means at predetermined positions P1, P2, and P3 in the turbomolecular pump 100. Referring to FIGS. 1, 5A, 5B, 6, and 7, a detailed description is given below.

Figure 5:
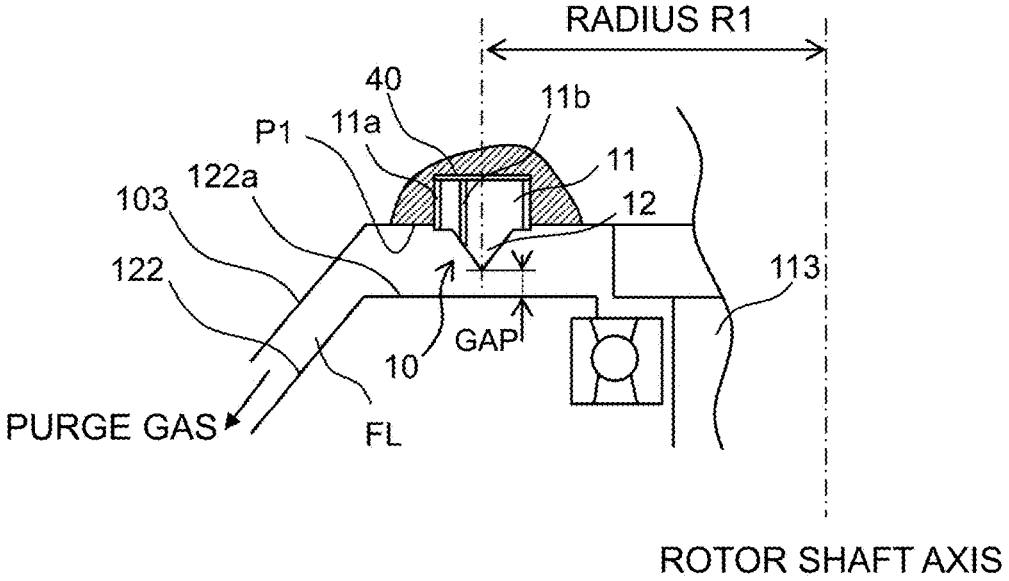
Figure 5:
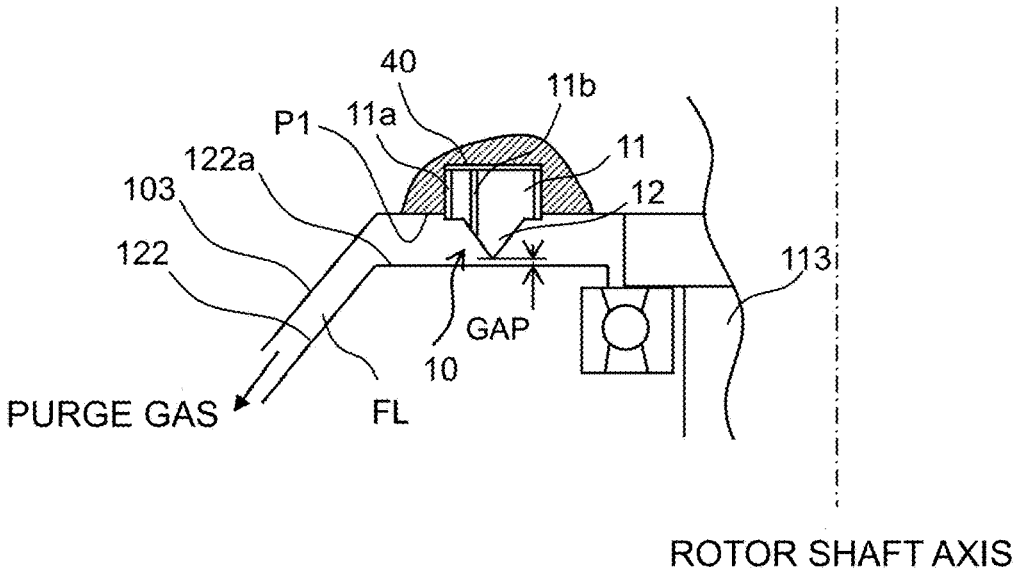
Figure 6:
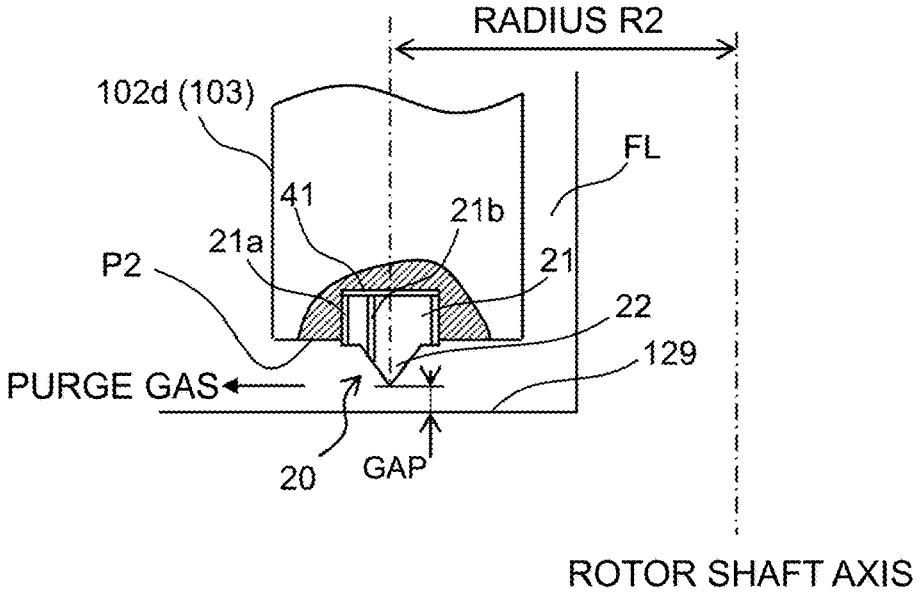
Figure 6:
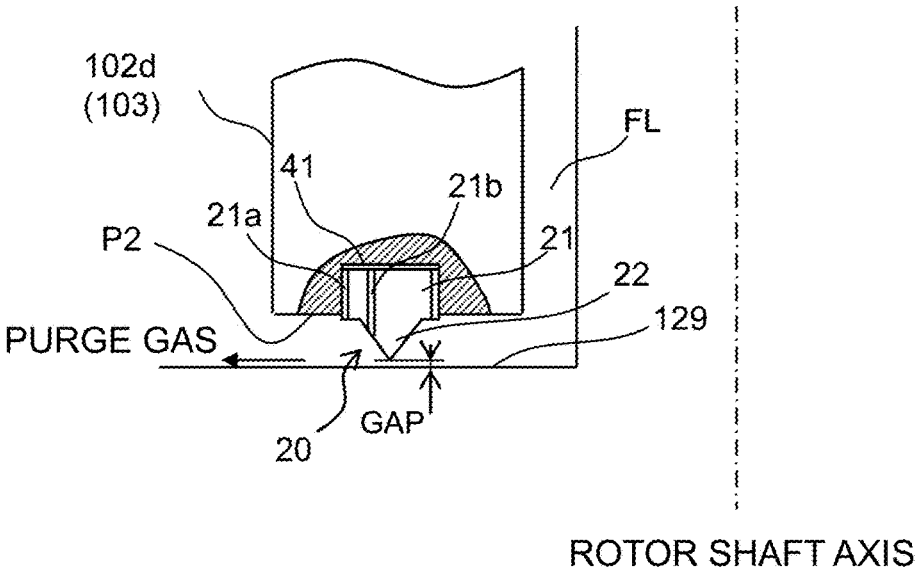

As shown in FIGS. 1, 5A, and 5B, the present example has a plurality of (three in the present example) projection portions 10 at positions P1 (first positions) formed on a surface in the back surface of the rotating body 103 facing an upper end surface 122*a* of the stator column 122. The plurality of projection portions 10 are arranged at the same radius R1 about an axis of the rotor shaft 113 and provided at intervals of 120 degrees in the rotational direction with respect to the axis of the rotor shaft 113. The number of projection portions 10 is not limited to three. When there are two projection portions 10, the positional relationship between the two projection portions 10 is symmetrical about a point on the axis of the rotor shaft 113.

FIGS. 5A and 5B show details of a projection portion 10. As shown in FIGS. 5A and 5B, the projection portion 10 has a columnar main body portion 11 and a conical distal end portion 12 coaxial with the main body portion 11. The distal end portion 12 is not limited to a conical shape as long as it has a pointed shape. The side surface of the main body portion 11 has a thread portion 11*a*, which is engaged with a threaded hole 40 formed in the back surface of the rotating body 103 to fix the projection portion 10 to the rotating body 103.

The projection portion 10 has a gas release hole 11*b*, which is parallel to the central axis and extends through the main body portion 11 and the distal end portion 12. When purge gas enters between the thread portion 11*a* and the threaded hole 40, the purge gas is discharged from the gas release hole 11*b*.

As shown in FIG. 5A, in a state in which the rotating body 103 is magnetically levitated, a gap is formed between the distal end portion 12 of the projection portion 10 and the upper end surface 122*a* of the stator column 122. Furthermore, as shown in FIG. 5B, in a state in which the rotating body 103 is not magnetically levitated, a gap is also formed between the distal end portion 12 of the projection portion 10 and the upper end surface 122*a* of the stator column 122. That is, the height of the projection portion 10 is set to a dimension that does not cause the projection portion 10 to come into contact with the upper end surface 122*a* of the stator column 122 even in a state in which the rotating body 103 is not magnetically levitated.

Also, as shown in FIGS. 1, 6A, and 6B, a plurality of (three in the present example) projection portions 20 are provided at positions P2 (second positions) formed on the bottom surface of the cylindrical portion 102*d* forming a lower portion of the rotating body 103. The plurality of projection portions 20 are arranged at the same radius R2 about the axis of the rotor shaft 113 and provided at intervals of 120 degrees in the rotational direction with respect to the axis of the rotor shaft 113.

FIGS. 6A and 6B show details of a projection portion 20. As shown in FIGS. 6A and 6B, the projection portion 20 has a columnar main body portion 21 and a conical distal end portion 22 coaxial with the main body portion 21. The distal end portion 22 is not limited to a conical shape as long as it has a pointed shape. The side surface of the main body portion 21 has a thread portion 21*a*, which is engaged with a threaded hole 41 formed in the bottom surface of the cylindrical portion 102*d* of the rotating body 103 to fix the projection portion 20 to the cylindrical portion 102*d*.

The projection portion 20 has a gas release hole 21*b*, which is parallel to the central axis and extends through the main body portion 21 and the distal end portion 22. When purge gas enters between the thread portion 21*a* and the threaded hole 41, the purge gas is discharged from the gas release hole 21*b*.

As shown in FIG. 6A, in a state in which the rotating body 103 is magnetically levitated, a gap is formed between the distal end portion 22 of the projection portion 20 and the base portion 129. Furthermore, as shown in FIG. 6B, in a state in which the rotating body 103 is not magnetically levitated, a gap is also formed between the distal end portion 22 of the projection portion 20 and the base portion 129. That is, the height of the projection portion 20 is set to a dimension that does not cause the projection portion 20 to come into contact with the base portion 129 even in a state in which the rotating body 103 is not magnetically levitated.

In this example, the projection portions 10 and 20 have the same shape in order to use common parts, but they have different shapes.

Figure 7:
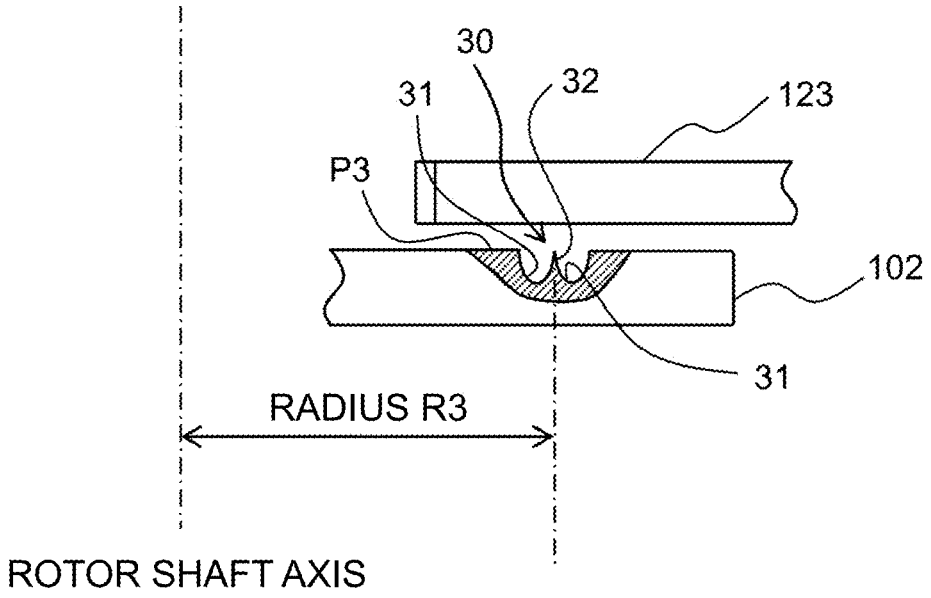
FIG. 7 is a diagram showing details of a projection portion 30.

As shown in FIGS. 1 and 7, a plurality of (three in the present example) projection portions 30 are provided at positions P3 (third positions) formed on surfaces (upper or lower surfaces) of rotor blades 102 among the rotor blades 102*a*, 102*b*, 102*c*, . . . in multiple stages that are located in the lowest stage. The projection portions 30 are provided on rotor blades 102, respectively. The three projection portions 30 are arranged at the same radius R3 about the axis of the rotor shaft 113 and provided at intervals of 120 degrees in the rotational direction with respect to the axis of the rotor shaft 113.

FIG. 7 shows details of a projection portion 30. The projection portion 30 is formed by cutting out a part of a surface of a rotor blade 102. Specifically, two recesses 31 are formed in the surface of the rotor blade 102, and a distal end portion 32 of a pointed shape is formed between the two recesses 31. In this example, the height of the distal end portion 32 is the same as that of the surface of the rotor blade 102. However, the distal end portion 32 may be configured to slightly project beyond the surface of the rotor blade 102 by raising the portion of the rotor blade 102 including the position P3 in advance and forming two recesses 31 in the raised portion.

The position of the distal end portion 32 is not limited to a middle position (radius R3) of the rotor blade 102 as shown in FIG. 7 and may be a position at the proximal end or a position at the distal end of the rotor blade 102.

Effect and Advantage

The turbomolecular pump 100 configured as described above has the following effects and advantages.

The electric charge carried on the rotating body 103 is discharged toward the stator column 122 from the projection portions 10. The electric charge discharged from the projection portions 10 flows through the stator column 122 and the base portion (casing) 129 in this order to be released to a ground line GL (see FIG. 1). The electric charge discharged from the projection portions 20 toward the base portion 129 is released directly to the ground line GL. The electric charge discharged from the projection portions 30 toward a stator blade 123 flows through the stator blade 123, the stator blade spacer 125, the outer cylinder (casing) 127, and the base portion 129 in this order, and is released to the ground line GL. In this manner, the present example allows the electric charge carried on the rotating body 103 to be discharged from the projection portions 10, 20, and 30 and released to the ground line GL in a reliable manner.

When particles adhere to the projection portions 10, the particles may scatter during discharging. However, in the present example, the positions P1 at which the projection portions 10 are provided are located on the back surface side of the rotating body 103, so that the particles are not mixed into the exhaust gas to flow back. This eliminates the possibility of contamination in the vacuum chamber.

Also, the positions P1 at which the projection portions 10 are provided are within the purge gas flow passage FL. Accordingly, even if particles scatter, the particles flow through the purge gas flow passage FL together with the purge gas and are discharged from the outlet port 133. This prevents contamination in the vacuum chamber.

The projection portions 20 are provided at the positions P2 formed on the bottom surface of the cylindrical portion 102*d* of the rotating body 103. Since the positions P2 are near the outlet of the purge gas flow passage FL, the particles adhering to the projection portions 20 are discharged from the outlet port 133 together with the purge gas during discharging. This prevents contamination in the vacuum chamber.

The projection portions 30, which are provided in the exhaust gas flow passage, are provided on rotor blades 102 in the lowest stage on the downstream side in the flow of the exhaust gas. Accordingly, even if the particles adhering to the projection portions 30 scatter into the exhaust gas during discharging, the rotor blades 102 and the stator blades 123 obstruct the backflow toward the vacuum chamber, minimizing the adverse effects of contamination in the vacuum chamber.

Furthermore, the projection portions 10, 20, and 30 have pointed shapes, thereby achieving high discharge effects. Moreover, the height of each projection portion 10 is set to a dimension that does not cause the projection portion 10 to come into contact with the upper end surface 122*a* of the stator column 122 even in a state in which the rotating body 103 is not magnetically levitated. Thus, the distal end portions 12 of the projection portions 10 will not be worn or damaged, resisting shape change. This prevents a decrease in the discharge effect. Also, the distal end portion of each projection portion 20 remains out of contact with the base portion 129, preventing a decrease in the discharge effect as with the projection portion 10. Furthermore, the projection portions 30 do not come into contact with the stator blades 123 even while the rotating body 103 is magnetically levitated, preventing a decrease in the discharge effect as with the projection portions 10 and 20.

The plurality of projection portions 10 are arranged at the same radius R1 from the axis of the rotor shaft 113 and arranged at regular intervals in the rotational direction with respect to the axis of the rotor shaft 113. This does not disturb the rotation balance of the rotating body 103. The projection portions 20 and 30 have the same advantageous effect.

It should be noted that not all projection portions 10, 20, and 30 have to be provided, as long as at least one of them is provided. Nevertheless, a projection portion is preferably provided at a position where discharge is likely to occur. Since the positions P1 are located on the upstream side of the positions P2 in the flow of the purge gas, the pressure is higher at the positions P1, facilitating discharging. As such, when the number of projection portions has to be reduced, at least a projection portion 10 may be provided at the position P1 on the back surface side facing the upper end surface 122*a* of the stator column 122 of the rotating body 103.

The present disclosure is not limited to the examples described above, and various modifications can be made without departing from the scope of the present disclosure. The present disclosure encompasses all technical matters included in the technical idea described in the claims. Although the foregoing examples illustrate preferred examples, other alternation, variations, modifications, or improvements will be apparent to those skilled in the art from the content disclosed herein, and may be made without departing from the technical scope defined by the appended claims.

What is claimed is:

1. A vacuum pump comprising:

a casing having an inlet port and an outlet port;

a stator column provided upright inside the casing;

a rotating body having a shape surrounding an outer circumference of the stator column; and a magnetic bearing configured to magnetically levitate and support a rotating shaft of the rotating body, the vacuum pump being configured to suck gas from the inlet port and exhaust the gas from the outlet port by rotation of the rotating body, wherein a projection portion for discharging an electric charge carried on the rotating body toward the stator column is provided at a first position formed on a surface in a back surface of the rotating body, with the surface facing an upper end surface of the stator column.

2. The vacuum pump according to claim 1, wherein the projection portion is set to have a height that does not cause the projection portion to come into physical contact with an upper end surface of the stator column even in a state in which the rotating body is not magnetically levitated.

3. The vacuum pump according to claim 1, wherein a purge gas flow passage, in which purge gas flows, is formed between the back surface of the rotating body and the upper end surface of the stator column.

4. The vacuum pump according to claim 1, wherein the projection portion has a pointed shape.

5. The vacuum pump according to claim 1, wherein the projection portion has a gas release hole.

6. The vacuum pump according to claim 1, wherein the projection portion is provided in plurality, and the plurality of projection portions are located at a same radius about an axis of the rotating body and located at mutually regular intervals in a rotational direction with respect to the axis of the rotating body.

7. A vacuum pump comprising:

a casing having an inlet port and an outlet port;

a stator column provided upright inside the casing;

a rotating body having a shape surrounding an outer circumference of the stator column; and a magnetic bearing configured to magnetically levitate and support a rotating shaft of the rotating body, the vacuum pump being configured to suck gas from the inlet port and exhaust the gas from the outlet port by rotation of the rotating body, wherein a projection portion is provided at a second position formed on a bottom surface of a cylindrical portion forming a lower portion of the rotating body and is configured to discharge an electric charge, carried on the rotating body, toward a base portion forming a bottom portion of the casing, and the projection portion is set to have a height that does not cause the projection portion to come into physical contact with the base portion even in a state in which the rotating body is not magnetically levitated.

8. The vacuum pump according to claim 7, wherein a purge gas flow passage, in which purge gas flows, is formed between the bottom surface of the cylindrical portion and the base portion.

9. A vacuum pump comprising:

a casing having an inlet port and an outlet port;

a stator column provided upright inside the casing;

a rotating body having a shape surrounding an outer circumference of the stator column; and a magnetic bearing configured to magnetically levitate and support a rotating shaft of the rotating body, the vacuum pump being configured to suck gas from the inlet port and exhaust the gas from the outlet port by rotation of the rotating body, wherein the rotating body includes, in multiple stages, a plurality of rotor blades, the casing includes, in multiple stages, a plurality of stator blades provided in a staggered manner with the plurality of rotor blades, and a projection portion is provided at a third position formed on a surface of a rotor blade among the plurality of rotor blades that is located on a downstream side, and is configured to discharge an electric charge carried on the rotating body toward a stator blade among the plurality of stator blades that is located in one of the stages located above and under the rotor blade that is located on the downstream side.

* * * * *